US009016487B2

(12) United States Patent
Kameyama

(10) Patent No.: US 9,016,487 B2
(45) Date of Patent: Apr. 28, 2015

(54) CRANE APPARATUS

(75) Inventor: Yasushi Kameyama, Kagawa (JP)

(73) Assignee: Tadano Ltd., Kagawa (JP)

( * ) Notice: Subject to any disclaimer, the term of this patent is extended or adjusted under 35 U.S.C. 154(b) by 489 days.

(21) Appl. No.: 13/307,224

(22) Filed: Nov. 30, 2011

(65) Prior Publication Data

US 2012/0138560 A1 Jun. 7, 2012

(30) Foreign Application Priority Data

Dec. 7, 2010 (JP) ..... 2010-272814

(51) Int. Cl.
*B66C 23/04* (2006.01)
*B66C 23/70* (2006.01)
*B66C 23/90* (2006.01)

(52) U.S. Cl.
CPC ..... *B66C 23/705* (2013.01); *B66C 23/905* (2013.01)

(58) Field of Classification Search
CPC .. B66C 23/905; B66C 23/703; B66C 23/705; B66C 23/706; B66C 23/707; B66C 13/22; B66C 13/46
USPC ..... 212/276, 277, 292, 299, 230, 231, 264, 212/347, 348, 349, 278, 279, 280, 281, 284
See application file for complete search history.

(56) References Cited

U.S. PATENT DOCUMENTS

| | | | | | |
|---|---|---|---|---|---|
| 3,658,189 | A * | 4/1972 | Brown et al. | ..... | 212/349 |
| 3,840,128 | A * | 10/1974 | Swoboda et al. | ..... | 414/728 |
| 4,011,699 | A * | 3/1977 | Mickelson | ..... | 52/115 |
| 5,731,987 | A * | 3/1998 | Strong et al. | ..... | 700/302 |
| 5,911,239 | A * | 6/1999 | Barthalow et al. | ..... | 137/599.16 |
| 5,927,520 | A * | 7/1999 | Barthalow et al. | ..... | 212/289 |
| 6,516,960 | B1 * | 2/2003 | Schlachter et al. | ..... | 212/270 |
| 7,458,308 | B2 * | 12/2008 | Badia | ..... | 91/189 A |
| 2005/0016946 | A1 * | 1/2005 | Davis | ..... | 212/230 |

FOREIGN PATENT DOCUMENTS

JP 2002-332194 11/2003

* cited by examiner

*Primary Examiner* — Emmanuel M Marcelo
*Assistant Examiner* — Justin Stefanon
(74) *Attorney, Agent, or Firm* — Oliff PLC

(57) ABSTRACT

A crane apparatus includes: a telescopic boom including a plurality of boom members, the telescopic boom performing telescopic motion by moving the plurality of boom members one by one using one telescopic cylinder; a condition input part configured to receive, as input, a condition for a crane operation including at least a weight of goods suspended by the telescopic boom, a height to which suspended goods are lifted, and a moving radius of the suspended goods; and a telescopic pattern selecting part configured to select a telescopic pattern that allows the crane operation under the condition inputted to the condition input part.

4 Claims, 6 Drawing Sheets

TABLE(1)

| TELESCOPIC BOOM LENGTH(m) | 12.8 | 12.8 | 17.1 | 17.1 | 17.1 | 21.4 | 21.4 | 21.4 | 21.4 | 25.8 | 25.8 | 25.8 | 25.8 | 30.1 | 30.1 | 30.1 | 30.1 |
|---|---|---|---|---|---|---|---|---|---|---|---|---|---|---|---|---|---|
| WEIGHT OF COUNTERWEIGHT(t) | 40.0 | 40.0 | 40.0 | 40.0 | 40.0 | 40.0 | 40.0 | 40.0 | 40.0 | 40.0 | 40.0 | 40.0 | 40.0 | 40.0 | 40.0 | 40.0 | 40.0 |
| WIDTH OF EXTENDED OUTRIGGER(m) | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 |
| MOVING RADIUS (m) 2.7 | 130.0 | | | | | | | | | | | | | | | | |
| 3.0 | 103.4 | 103.4 | 86.9 | 86.9 | 45.5 | 86.9 | 85.6 | 46.6 | 34.5 | | | | | | | | |
| 3.5 | 94.4 | 94.4 | 86.9 | 84.0 | 42.8 | 86.9 | 80.2 | 46.6 | 32.0 | 70.0 | 50.0 | 46.6 | 34.7 | | | | |
| 4.0 | 86.8 | 86.8 | 86.9 | 79.0 | 40.5 | 86.9 | 75.5 | 46.0 | 29.9 | 70.0 | 50.0 | 46.6 | 33.0 | | | | |
| 4.5 | 80.2 | 80.2 | 80.5 | 74.5 | 38.3 | 80.3 | 71.3 | 44.0 | 28.0 | 70.0 | 50.0 | 45.7 | 31.1 | 54.3 | 50.0 | 42.4 | 26.6 |
| 5.0 | 74.5 | 74.5 | 74.7 | 70.5 | 36.4 | 74.5 | 67.5 | 41.6 | 26.3 | 70.0 | 50.0 | 44.0 | 29.2 | 51.3 | 50.0 | 42.4 | 25.4 |
| 6.0 | 64.7 | 64.7 | 65.0 | 63.8 | 33.1 | 64.8 | 61.0 | 37.2 | 23.5 | 65.4 | 50.0 | 40.9 | 26.0 | 46.1 | 50.0 | 42.4 | 23.1 |
| 7.0 | 56.6 | 56.6 | 56.9 | 57.4 | 30.4 | 56.7 | 55.7 | 33.6 | 21.2 | 57.3 | 46.6 | 37.3 | 23.3 | 41.8 | 49.3 | 39.6 | 20.6 |
| 8.0 | 49.7 | 49.7 | 50.0 | 50.6 | 28.2 | 49.8 | 50.8 | 30.7 | 19.3 | 50.5 | 43.2 | 34.3 | 21.2 | 38.2 | 46.0 | 36.7 | 18.6 |
| 9.0 | 43.9 | 43.9 | 44.2 | 44.8 | 26.2 | 44.0 | 44.9 | 28.2 | 17.7 | 44.7 | 40.2 | 31.7 | 19.4 | 35.2 | 43.1 | 34.1 | 16.9 |
| 10.0 | 38.3 | 38.3 | 39.4 | 40.0 | 24.6 | 39.2 | 40.1 | 26.0 | 16.3 | 39.9 | 37.7 | 29.4 | 17.8 | 32.2 | 40.6 | 31.9 | 15.5 |
| 11.0 | | | 35.4 | 35.9 | 23.2 | 35.1 | 36.1 | 24.2 | 15.1 | 35.8 | 35.4 | 27.5 | 16.5 | 29.5 | 36.7 | 30.0 | 14.3 |
| 12.0 | | | 32.0 | 32.5 | 22.0 | 31.7 | 32.7 | 22.6 | 14.1 | 32.4 | 33.5 | 25.8 | 15.3 | 27.2 | 33.2 | 28.3 | 13.2 |
| 14.0 | | | 26.5 | 27.1 | 20.2 | 26.2 | 27.2 | 20.0 | 12.4 | 26.9 | 28.2 | 22.9 | 13.4 | 23.3 | 27.7 | 25.4 | 11.5 |
| 16.0 | | | | | | 21.4 | 22.4 | 18.0 | 11.1 | 22.1 | 23.4 | 20.7 | 11.9 | 20.3 | 22.9 | 23.0 | 10.1 |
| 18.0 | | | | | | 17.6 | 18.6 | 16.4 | 10.1 | 18.2 | 19.5 | 18.8 | 10.7 | 17.8 | 19.0 | 20.3 | 9.0 |
| 20.0 | | | | | | | | | | 15.3 | 16.5 | 17.3 | 9.8 | 14.9 | 16.1 | 17.3 | 8.1 |
| 22.0 | | | | | | | | | | 13.0 | 14.2 | 15.1 | 9.0 | 12.6 | 13.7 | 14.9 | 7.3 |
| 24.0 | | | | | | | | | | | | | | 10.7 | 11.8 | 13.0 | 6.7 |
| 26.0 | | | | | | | | | | | | | | 9.2 | 10.3 | 11.5 | 6.1 |
| 28.0 | | | | | | | | | | | | | | | | | |
| 30.0 | | | | | | | | | | | | | | | | | |
| 32.0 | | | | | | | | | | | | | | | | | |
| 34.0 | | | | | | | | | | | | | | | | | |
| 36.0 | | | | | | | | | | | | | | | | | |
| 38.0 | | | | | | | | | | | | | | | | | |
| 40.0 | | | | | | | | | | | | | | | | | |
| 42.0 | | | | | | | | | | | | | | | | | |
| 44.0 | | | | | | | | | | | | | | | | | |
| 46.0 | | | | | | | | | | | | | | | | | |
| 48.0 | | | | | | | | | | | | | | | | | |
| 50.0 | | | | | | | | | | | | | | | | | |
| 52.0 | | | | | | | | | | | | | | | | | |
| 54.0 | | | | | | | | | | | | | | | | | |
| 56.0 | | | | | | | | | | | | | | | | | |
| 58.0 | | | | | | | | | | | | | | | | | |
| 60.0 | | | | | | | | | | | | | | | | | |
| MAXIMUM LIFTING HEIGHT(m) | 13 | | 18 | | | 22 | | | | 26 | | | | 31 | | | |
| TELESCOPIC RATE OF SECOND BOOM(%) | 0 | 0 | 0 | 0 | 0 | 46 | 0 | 0 | 0 | 46 | 0 | 0 | 0 | 92 | 46 | 0 | 0 |
| TELESCOPIC RATE OF THIRD BOOM(%) | 0 | 0 | 46 | 0 | 0 | 46 | 46 | 0 | 0 | 46 | 46 | 0 | 0 | 46 | 46 | 46 | 0 |
| TELESCOPIC RATE OF FOURTH BOOM(%) | 0 | 0 | 0 | 46 | 0 | 0 | 46 | 0 | 0 | 46 | 46 | 46 | 0 | 46 | 46 | 46 | 0 |
| TELESCOPIC RATE OF FIFTH BOOM(%) | 0 | 0 | 0 | 0 | 0 | 0 | 0 | 46 | 0 | 0 | 46 | 46 | 46 | 0 | 46 | 46 | 92 |
| TELESCOPIC RATE OF TOP BOOM(%) | 0 | 0 | 0 | 0 | 46 | 0 | 0 | 46 | 92 | 0 | 0 | 46 | 92 | 0 | 0 | 46 | 92 |
| TELESCOPIC PATTERN No. | 1 | | 2 | 3 | 4 | 5 | 6 | 7 | 8 | 9 | 10 | 11 | 12 | 13 | 14 | 15 | 16 |

*FIG.4*

TABLE (2)

| TELESCOPIC BOOM LENGTH (m) | 34.4 | 34.4 | 34.4 | 34.4 | 38.7 | 38.7 | 38.7 | 43.0 | 43.0 | 43.0 | 43.0 | 47.4 | 47.4 | 47.4 | 51.7 | 51.7 | 56.0 | 60.0 |
|---|---|---|---|---|---|---|---|---|---|---|---|---|---|---|---|---|---|---|
| WEIGHT OF COUNTERWEIGHT (t) | 40.0 | 40.0 | 40.0 | 40.0 | 40.0 | 40.0 | 40.0 | 40.0 | 40.0 | 40.0 | 40.0 | 40.0 | 40.0 | 40.0 | 40.0 | 40.0 | 40.0 | 40.0 |
| WIDTH OF EXTENDED OUTRIGGER (m) | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 | 7.5 |
| MOVING RADIUS (m) 2.7 | | | | | | | | | | | | | | | | | | |
| 3.0 | | | | | | | | | | | | | | | | | | |
| 3.5 | | | | | | | | | | | | | | | | | | |
| 4.0 | | | | | | | | | | | | | | | | | | |
| 4.5 | | | | | | | | | | | | | | | | | | |
| 5.0 | 44.0 | 38.0 | 29.5 | 25.1 | | | | | | | | | | | | | | |
| 6.0 | 42.2 | 38.0 | 28.6 | 23.4 | 32.8 | 27.4 | 20.5 | | | | | | | | | | | |
| 7.0 | 38.4 | 38.0 | 26.8 | 21.9 | 32.8 | 26.9 | 20.5 | 27.1 | 23.1 | 20.7 | 19.0 | | | | | | | |
| 8.0 | 35.1 | 38.0 | 24.9 | 20.5 | 32.6 | 25.5 | 20.0 | 27.1 | 23.1 | 20.3 | 19.0 | 21.4 | 18.6 | 15.7 | | | | |
| 9.0 | 32.4 | 35.8 | 23.3 | 19.1 | 30.3 | 24.3 | 18.5 | 27.1 | 23.1 | 19.4 | 18.5 | 21.4 | 18.6 | 15.7 | 16.6 | 14.3 | | |
| 10.0 | 29.9 | 33.7 | 21.9 | 17.8 | 28.1 | 23.1 | 17.2 | 26.0 | 23.0 | 18.5 | 17.7 | 21.4 | 18.6 | 15.7 | 16.6 | 14.3 | 13.2 | |
| 11.0 | 27.8 | 31.8 | 20.6 | 16.5 | 26.2 | 21.9 | 16.0 | 24.7 | 22.1 | 17.7 | 16.7 | 21.4 | 18.6 | 15.7 | 16.6 | 14.3 | 13.2 | 10.6 |
| 12.0 | 26.0 | 30.1 | 19.5 | 15.3 | 24.5 | 20.8 | 14.9 | 23.1 | 21.2 | 16.9 | 15.7 | 20.9 | 18.1 | 15.7 | 16.6 | 14.3 | 13.2 | 10.6 |
| 14.0 | 22.5 | 27.2 | 17.5 | 13.3 | 21.6 | 18.8 | 13.2 | 20.4 | 19.6 | 15.5 | 14.0 | 19.2 | 16.7 | 14.5 | 16.4 | 14.3 | 13.2 | 10.6 |
| 16.0 | 19.6 | 23.8 | 15.8 | 11.8 | 19.3 | 17.2 | 11.7 | 18.2 | 18.0 | 14.4 | 12.6 | 17.4 | 15.2 | 13.2 | 15.5 | 13.4 | 13.1 | 10.6 |
| 18.0 | 17.2 | 19.9 | 14.3 | 10.6 | 17.1 | 15.8 | 10.6 | 16.4 | 16.7 | 13.2 | 11.4 | 15.4 | 13.9 | 12.0 | 14.4 | 12.5 | 12.4 | 10.5 |
| 20.0 | 15.3 | 16.9 | 13.0 | 9.5 | 15.2 | 14.7 | 9.5 | 14.5 | 15.1 | 12.1 | 10.4 | 13.8 | 12.8 | 11.0 | 13.4 | 11.5 | 11.8 | 10.4 |
| 22.0 | 13.3 | 14.5 | 11.9 | 8.7 | 13.6 | 13.5 | 8.6 | 13.0 | 13.5 | 11.1 | 9.6 | 12.4 | 11.7 | 10.2 | 12.0 | 10.7 | 11.1 | 9.6 |
| 24.0 | 11.4 | 12.6 | 11.0 | 8.0 | 12.1 | 12.4 | 7.8 | 11.6 | 12.2 | 10.2 | 8.8 | 11.2 | 10.7 | 9.2 | 10.9 | 9.9 | 10.3 | 8.8 |
| 26.0 | 9.8 | 11.0 | 10.3 | 7.3 | 10.5 | 11.6 | 7.1 | 10.5 | 11.1 | 9.4 | 8.1 | 10.2 | 9.8 | 8.4 | 9.9 | 9.3 | 9.7 | 8.0 |
| 28.0 | 8.5 | 9.7 | 9.6 | 6.8 | 9.2 | 10.3 | 6.6 | 9.3 | 9.8 | 8.7 | 7.5 | 9.3 | 9.0 | 7.7 | 9.0 | 8.6 | 8.9 | 7.3 |
| 30.0 | 7.5 | 8.6 | 9.1 | 6.4 | 8.1 | 9.1 | 6.0 | 8.1 | 8.6 | 8.1 | 6.9 | 8.4 | 8.3 | 7.1 | 8.3 | 7.9 | 8.1 | 6.7 |
| 32.0 | | | | | 7.1 | 8.1 | 5.6 | 7.2 | 7.7 | 7.6 | 6.5 | 7.4 | 7.7 | 6.6 | 7.6 | 7.4 | 7.5 | 6.2 |
| 34.0 | | | | | 6.3 | 7.3 | 5.2 | 6.3 | 6.8 | 7.1 | 6.0 | 6.5 | 7.2 | 6.1 | 6.8 | 6.8 | 6.9 | 5.7 |
| 36.0 | | | | | | | | 5.6 | 6.1 | 6.7 | 5.6 | 5.8 | 6.5 | 5.7 | 6.1 | 6.4 | 6.4 | 5.3 |
| 38.0 | | | | | | | | 5.0 | 5.4 | 6.2 | 5.3 | 5.1 | 5.8 | 5.3 | 5.4 | 6.0 | 5.7 | 4.9 |
| 40.0 | | | | | | | | 4.4 | 4.9 | 5.6 | 5.0 | 4.6 | 5.2 | 4.9 | 4.9 | 5.6 | 5.2 | 4.5 |
| 42.0 | | | | | | | | | | | | 4.1 | 4.7 | 4.6 | 4.4 | 5.1 | 4.7 | 4.2 |
| 44.0 | | | | | | | | | | | | 3.6 | 4.2 | 4.3 | 3.9 | 4.6 | 4.2 | 3.9 |
| 46.0 | | | | | | | | | | | | | | | 3.5 | 4.2 | 3.8 | 3.6 |
| 48.0 | | | | | | | | | | | | | | | 3.1 | 3.8 | 3.4 | 3.4 |
| 50.0 | | | | | | | | | | | | | | | | | 3.0 | 3.0 |
| 52.0 | | | | | | | | | | | | | | | | | 2.7 | 2.6 |
| 54.0 | | | | | | | | | | | | | | | | | | 2.3 |
| 56.0 | | | | | | | | | | | | | | | | | | 2.0 |
| 58.0 | | | | | | | | | | | | | | | | | | |
| 60.0 | | | | | | | | | | | | | | | | | | |
| MAXIMUM LIFTING HEIGHT (m) | 35 | | | | 39 | | | 43 | | | | 47 | | | 52 | | 56 | 60 |
| TELESCOPIC RATE OF SECOND BOOM (%) | 92 | 46 | 0 | 0 | 92 | 46 | 0 | 92 | 92 | 46 | 0 | 92 | 46 | 0 | 92 | 46 | 92 | 100 |
| TELESCOPIC RATE OF THIRD BOOM (%) | 46 | 46 | 46 | 0 | 46 | 46 | 0 | 92 | 46 | 46 | 46 | 92 | 92 | 92 | 92 | 92 | 92 | 100 |
| TELESCOPIC RATE OF FOURTH BOOM (%) | 46 | 46 | 46 | 46 | 46 | 46 | 92 | 46 | 46 | 46 | 92 | 92 | 92 | 92 | 92 | 92 | 92 | 100 |
| TELESCOPIC RATE OF FIFTH BOOM (%) | 46 | 46 | 46 | 92 | 46 | 46 | 92 | 46 | 46 | 92 | 92 | 46 | 92 | 92 | 92 | 92 | 92 | 100 |
| TELESCOPIC RATE OF TOP BOOM (%) | 0 | 46 | 92 | 92 | 46 | 92 | 92 | 46 | 92 | 92 | 92 | 46 | 46 | 92 | 46 | 92 | 92 | 100 |
| TELESCOPIC PATTERN No. | 17 | 18 | 19 | 20 | 21 | 22 | 23 | 24 | 25 | 26 | 27 | 28 | 29 | 30 | 31 | 32 | 33 | 34 |

*FIG.5*

CRANE APPARATUS

CROSS REFERENCE TO RELATED APPLICATIONS

This application claims priority of Japanese Patent Application No. 2010-272814 filed on Dec. 7, 2010. The contents of this application are incorporated herein by reference in their entirety.

BACKGROUND

1. Field of the Invention

The present invention relates to a crane apparatus having a telescopic boom composed of a plurality of boom members. These boom members are telescopically configured, and the telescopic boom expands and contracts by moving the telescopic members one by one using one telescopic cylinder.

2. Description of the Related Art

Conventionally, as this sort of crane apparatuses, one has been known that includes a telescopic boom composed of a plurality of boom members, where the telescopic boom performs telescopic motion by moving these boom members one by one using one telescopic cylinder (see, for example, Japanese Patent Application Laid-Open Publication No. 2002-332194.

SUMMARY

If a crane apparatus has a six-stage telescopic boom, there are thirty or more kinds of telescopic patterns. The operator has to select an optimum telescopic pattern from among thirty or more telescopic patterns for each crane operation, and consumes a long period of time to select a telescopic pattern. Particularly, when consecutively performing a plurality of crane operations, the operator has to select respective patterns for the crane operations taking into account the order of the crane operations, and therefore selection of telescopic patterns becomes complicated.

It is therefore, an object of the present invention to provide a crane apparatus being capable of selecting telescopic patterns of a telescopic boom for a short period of time without time-consuming process.

According to some aspects of the present invention, a crane apparatus includes: a telescopic boom including a plurality of boom members, the telescopic boom performing telescopic motion by moving the plurality of boom members one by one using one telescopic cylinder; a condition input part configured to receive, as input, a condition for a crane operation including at least a weight of goods suspended by the telescopic boom, a height to which suspended goods are lifted, and a moving radius of the suspended goods; and a telescopic pattern selecting part configured to select a telescopic pattern that allows the crane operation under the condition inputted to the condition input part.

According to some aspects of the present invention, when there are a plurality of telescopic patterns that allow the crane operation under the condition inputted to the condition input part, the telescopic pattern selecting part selects a telescopic pattern that minimizes a period of time for telescopic motion changing from a previous telescopic pattern. According to other aspects of the present invention, the condition input part can receive, as input, conditions for a plurality of crane operations and an order of the crane operations; and when there are a plurality of telescopic patterns of the telescopic boom that allow the crane operation under each condition inputted from the condition input part, the telescopic pattern selecting part selects each telescopic pattern that minimizes a period of time for entire telescopic motion of the telescopic boom changing from a telescopic pattern before a telescopic motion to a telescopic pattern of a last crane operation. According to other aspects of the present invention, when there are a plurality of telescopic patterns of the telescopic boom that allow the crane operation under the condition inputted to the condition input part, the telescopic pattern selecting part selects a telescopic pattern that maximizes a net rated load.

According to some aspects of the present invention, a telescopic pattern that allows a crane operation is selected from among a plurality of telescopic patterns by inputting a predetermined condition, which is easy operation. By this means, it is possible to improve operational efficiency.

According to some aspects of the present invention, when a plurality of telescopic patterns match the condition inputted to a condition input part, a telescopic pattern is selected to minimize a period of time for telescopic motion changing from the previous telescopic pattern. By this means, it is possible to further improve operational efficiency. According to other aspects of the present invention, when a plurality of telescopic patterns match each condition inputted to the condition input part, a telescopic pattern of the telescopic boom is selected for each condition to minimize a period of time required for telescopic motion for a plurality of crane operations. By this means, it is possible to further improve operational efficiency. According to other aspects of the present invention, when a plurality of telescopic patterns match the condition inputted to the condition input part, the telescopic boom can suspend goods, in a telescopic pattern having a substantially greater net rated load than the weight of the suspended goods. By this means, it is possible to improve safety.

BRIEF DESCRIPTION OF THE DRAWINGS

FIG. 4 shows performance table (1) of the telescopic boom;

FIG. 5 shows performance table (2) of the telescopic boom; and

DETAILED DESCRIPTION

FIG. 1 to FIG. 6 show one embodiment of the present invention. With the present embodiment, a mobile crane adopting the crane apparatus of the present invention, will be described.

Figure 1:
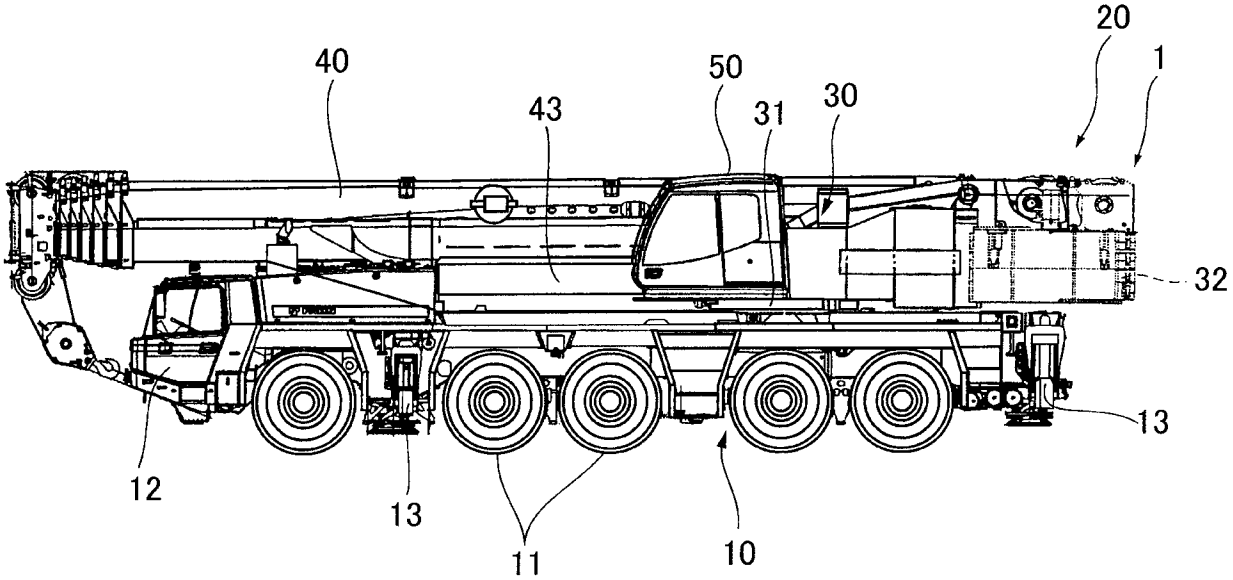
FIG. 1 is a side view showing a mobile crane according to one embodiment of the present invention.

A mobile crane 1 includes a vehicle 10 for running and a crane apparatus 20, as shown in FIG. 1.

The vehicle 10 has a plurality of pairs of wheels 11 on both the left and right sides in the longitudinal direction, and runs by an engine as power source. A vehicle cabin 12 is provided in the front part of the vehicle 10, where operation for running of the vehicle 10 is performed. In addition, outriggers 13 are provided in the front part and back part of the vehicle 10 on both the left and right sides to prevent the vehicle 10 from falling down and stably support the vehicle 10 during a crane operation. When being used, each outrigger 13 is extended downward by a jack cylinder to contact the ground at the bottom.

The crane apparatus 20 includes a swivel base 30 pivotably provided in the center part of the vehicle 10 in the longitudinal direction; a telescopic boom 40 provided to perform derricking movement with respect to the swivel base 30 and to perform telescopic motion; and a crane cabin 50 provided on the swivel base 30.

The swivel base 30 is configured to be able to swivel with respect to the vehicle 10 by means of a ball bearing or roller bearing swivel support 31. The swivel base 30 is driven by a swivel hydraulic motor (not shown).

The telescopic boom 40 includes a plurality of boom members 41, a telescopic cylinder 42 to enable telescopic motion of each boom member 41 and a derrick cylinder 43 to perform derricking motion of the telescopic boom 40.

Figure 2A:
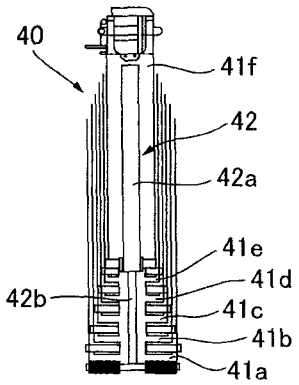
FIGS. 2A and 2B are schematic views each showing a telescopic boom.
Figure 2B:
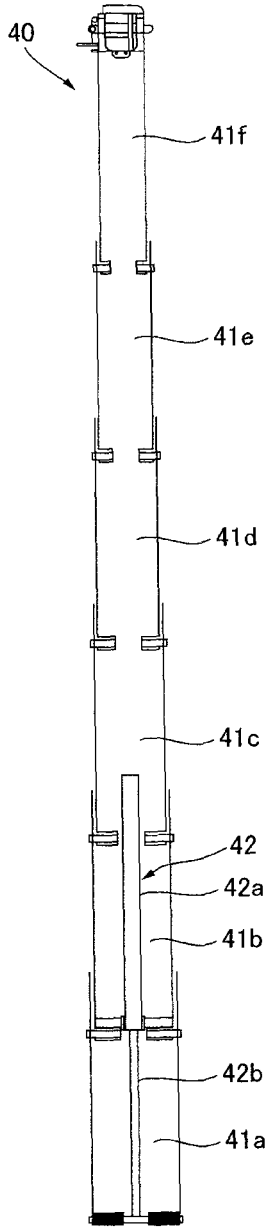

Except for the top boom member 41, each of the plurality of boom members 41 is hollow to accommodate the boom member 41 adjacent above thereof. The telescopic boom 40 can perform telescopic motion by moving the boom member 41 adjacent above each boom member 41 with respect to the each boom member 41. In addition, a boom lock mechanism (not shown) is provided between each boom member 41 and the boom member 41 located inside the each boom member 41, to releasably engage the boom member 41 located inside the each boom member 41 with the each boom member 41 at a predetermined position. As shown in FIG. 2, the telescopic boom 40 according to the present embodiment has a six-stage structure including a base boom member 41*a*, a second boom member 41*b*, a third boom member 41*c*, a fourth boom member 41*d*, a fifth boom member 41*e*, and a top boom member 41*f* in this order from the bottom side. FIG. 2A shows the minimum length state of the telescopic boom 40, and FIG. 2B shows the maximum length state of the telescopic boom 40. Moreover, assuming that the maximum length state in which the boom member 41 adjacent above each boom member 41 maximally extends from the each boom member 41 is 100%, the boom lock member can fix the boom member 41 adjacent above the each boom member 41 at the positions the boom member 41 adjacent above the each boom member 41 extends 46%, 92%, and 100% from the each boom member 41.

As shown in FIGS. 2A and 2B, the telescopic cylinder 42 includes a cylinder part 42*a* and a rod part 42*b*. The end of the rod part 42*b* is coupled to the interior of the base boom member 41*a*. A cylinder and boom coupling mechanism is provided in the cylinder part 42*a* of the telescopic cylinder 42. This cylinder and boom coupling mechanism detachably couples the bottom of each boom member 41 other than the base boom member 41*a*, with the cylinder part 42*a* of the telescopic cylinder 42. In addition, a lock releasing mechanism (not shown) is provided in the cylinder part 42*a* of the telescopic cylinder 42. This lock releasing mechanism releases the coupling between each boom member 41 and the neighboring boom member 41, which has been made by the boom lock mechanism.

Telescopic motion of the telescopic boom 40 is accomplished as follows: the boom member 41 targeted for telescopic motion is coupled with the cylinder part 42*a* by the cylinder and boom coupling mechanism; the coupling between the boom member 41 targeted for telescopic motion and the neighboring boom member 41 in the bottom side, which has been made by the boom lock mechanism, is released; and the telescopic cylinder 42 is driven.

The crane cabin 50 is provided on the swivel base 30 in the telescopic boom 40 side, where operation for a crane operation is performed.

In addition, a counterweight 32 is detachably mounted to the back part of the swivel base 30 in order to assure the stability when goods are suspended from the tip of the telescopic boom 40.

Moreover, the mobile crane 1 includes a controller 60 that controls to select a telescopic pattern that allows a crane operation under a predetermined condition, from among multiple kinds of telescopic patterns of the telescopic boom 40.

The controller 60 has a CPU, a ROM and a RAM. Upon receiving an input signal from a device connected to the input side, the controller 60 reads a program stored in the ROM based on the input signal, stores the state detected with the input signal in the RAM, and transmits an output signal to a device connected to the output side.

Figure 3:
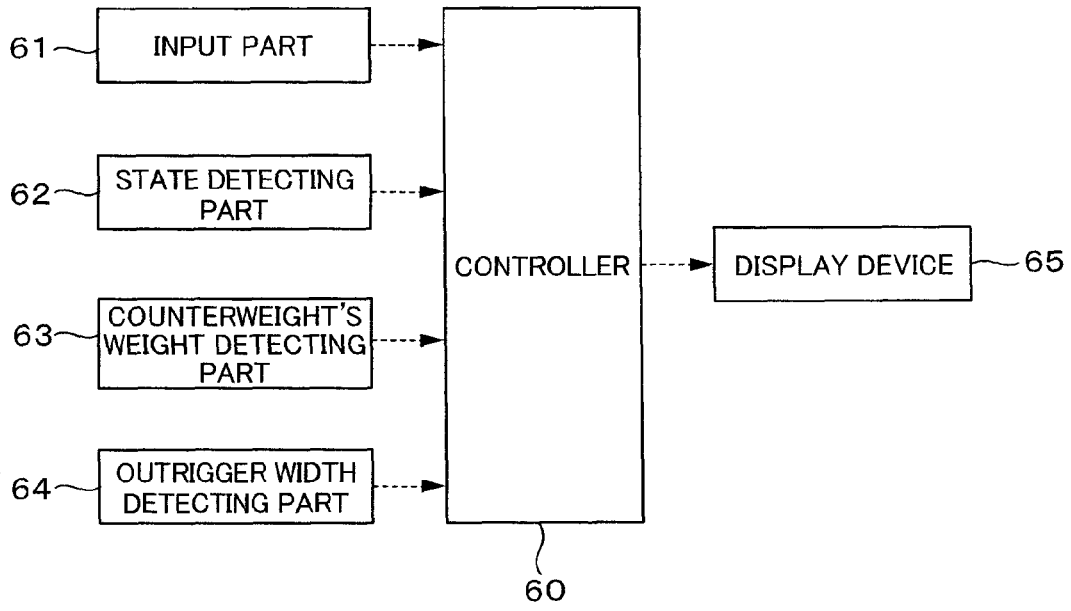
FIG. 3 is a block diagram showing a control system.

As shown in FIG. 3, the following components are connected to the input side of the controller 60: an input part 61 such as a numeric keypad or a touch panel for inputting an operating condition including goods' weight W suspended by the telescopic boom 40, height H to which the suspended goods are lifted (lifting height), and moving radius R of the suspended goods; a state detecting part 62 for detecting the state of the telescopic boom 40, such as a derricking angle and a telescopic pattern; a counterweight's weight detecting part 63 for detecting the weight of the counterweight 32; and an outrigger width detecting part 64 for detecting the width of the extended outriggers 13. The controller 60 receives, as input, an input signal representing the condition inputted to the input part 61, and detection signals representing the state of the telescopic boom 40, the weight of the counterweight 32 and the width of the extended outriggers 13.

When there are a plurality of telescopic patterns that allow a crane operation under a predetermined condition, the input part 61 can set a priority by determining which of the telescopic patterns should be preferentially selected between the telescopic pattern that minimizes a period of time for telescopic motion and the telescopic pattern that maximizes a net rated load. In addition, when crane operations under different operating conditions are consecutively performed, the input part 61 can receive a plurality of operating conditions, as input.

As shown in FIG. 3, a display device 65 is connected to the output side of the controller 60. The display device 65 may be a liquid crystal display for displaying a telescopic pattern of the telescopic boom 40 that allows the crane operation selected based on the input signal and detection signals. The controller 60 transmits a display signal representing the contents of the display to the display device 65.

The ROM of the controller 60 stores data corresponding to the performance tables shown in FIG. 4 and FIG. 5 each shows good's weight W that can be suspended by the telescopic boom 40 for a crane operation. The weight W is obtained based on the weight of the counterweight 32, the width of the extended outriggers 13, lengths of the telescopic boom 40, telescopic patterns, moving radius R, maximum height (lifting height) H to which the suspended goods are lifted. Here, in the performance tables in shown FIG. 4 and FIG. 5, the weight of the counterweight 32 is 40 t, and the width of the extended outriggers 13 is 7.5 m. The ROM of the controller 60 may also store data corresponding to another performance table including a different weight of counterweight 32 and a different width of the extended outriggers 13. In addition, although FIG. 4 and FIG. 5 show the performance tables when telescopic boom 40 is used by itself, the ROM of the controller 60 may store data corresponding to another performance table for a case where a jib is attached to the tip of the telescopic boom 40. In FIG. 4, the difference in weight W of the suspended goods written in the vertical row of telescopic pattern No. 1 shows the difference in the net rated load depending on the orientation of the swivel base 30 with respect to the vehicle 10. The controller 60 refers to data corresponding to the performance tables stored in the ROM, extracts telescopic patterns satisfying conditions, and selects a telescopic pattern satisfying the priority from among the extracted telescopic patterns.

Figure 6:
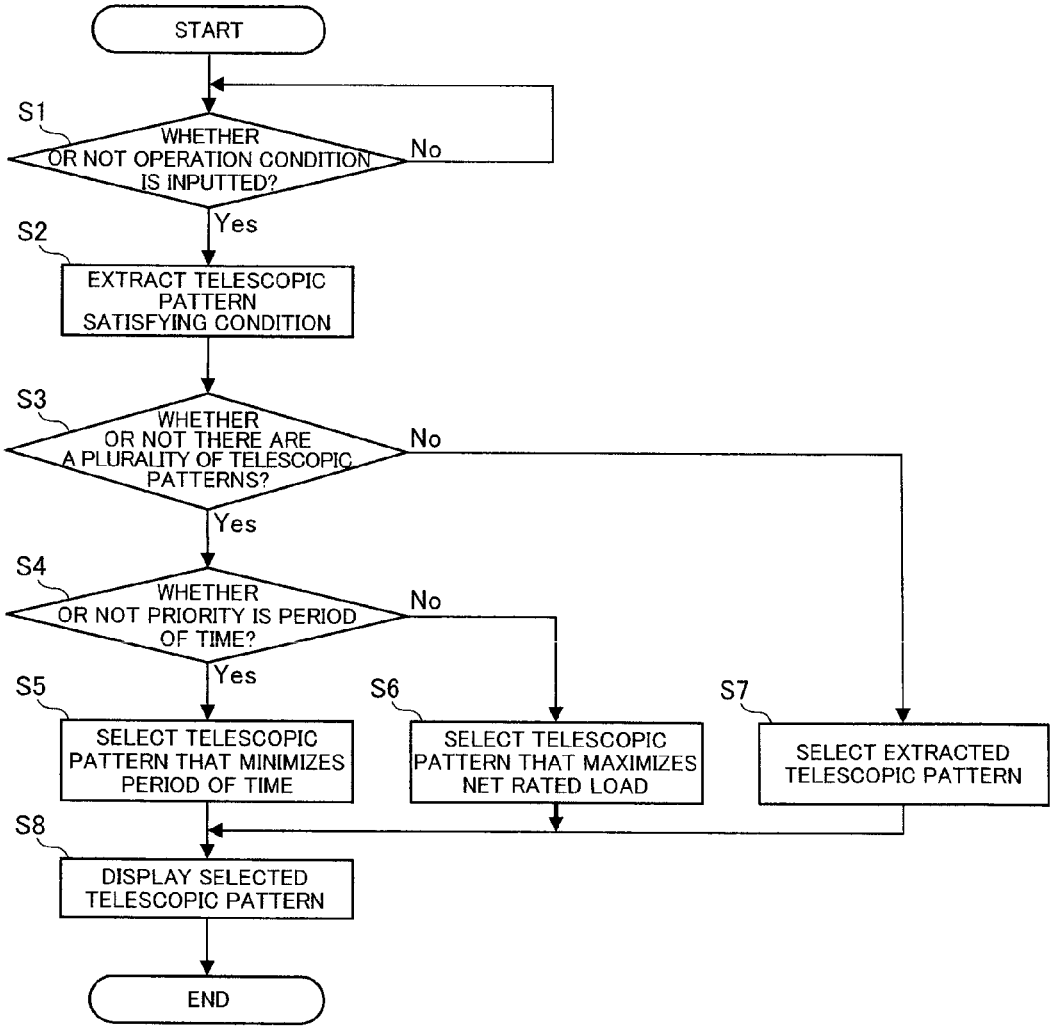
FIG. 6 is a flow chart showing a process of selecting a telescopic pattern.

For the crane apparatus 1 having the above-described configuration, when operating conditions are inputted to the input part 61, the controller 60 performs a process of selecting a telescopic pattern shown in FIG. 6.

(Step S1)

In step S1, the CPU determines whether or not operating conditions are inputted to the input part 61. When the operating conditions have been inputted, the step moves to step S2.

(Step S2)

In a case in which the CPU determines that the operating conditions have been inputted to the input part 61 in step S1, the CPU extracts a telescopic pattern satisfying the condition from all the telescopic patterns in step S2, and the step moves to step S3.

(Step S3)

In step S3, the CPU determines whether or not multiple kinds of telescopic patterns have been extracted in step 2. When the CPU determines that multiple kinds of telescopic patterns have been extracted, the step moves to step S4, and, on the other hand, when it determines that multiple kinds of telescopic patterns have not been extracted (one kind of telescopic pattern has been extracted), the step moves to step S7.

(Step S4)

In step S3, when the CPU determines that multiple kinds of telescopic patterns have been extracted, it determines whether or not the priority is time in step S4. When the CPU determines that the priority is time, the step moves to step S5, and, on the other hand, when the CPU determines that the priority is not time (the priority is net rated load), the step moves to step S6.

(Step S5)

In step S4, when the CPU determines that the priority is time, the CPU selects a telescopic pattern of the telescopic boom 40 that minimizes the period of time for telescopic motion changing from the telescopic pattern detected by the state detecting part 62, from among the extracted telescopic patterns in step S5, and the step moves to step S8.

(Step S6)

When the CPU determines that the priority is not time (but net rated load) in step S4, it selects a telescopic pattern that maximizes the net rated load from among the extracted telescopic patterns in step S6, and the step moves to step S8.

(Step S7)

In step S3, when the CPU determines that multiple kinds of telescopic patterns have not been extracted (one kind of telescopic pattern has been extracted), the CPU selects the extracted telescopic pattern in step S7, and the step moves to step S8.

(Step S8)

In step S8, the CPU displays the telescopic pattern selected in any of steps S5 to S7, on the display device 65, and ends the process of selecting a telescopic pattern.

In step S5 or step S6, when a plurality of telescopic patterns match one priority, the CPU selects the telescopic pattern satisfying the other priority. In addition, when a plurality of telescopic patterns match both the priorities, the CPU selects all these telescopic patterns.

Here, a process of selecting telescopic patterns will be described in detail where the counterweight 32 is 40 t and the width of the extended outriggers 13 is 7.5 m; the input part 61 receives, as input, an operating condition that weight W of the suspended goods is 10 t, working radius R is 20 m, and lifting height H is 37 m; and a net rated load is set as the priority.

First, when the operating condition (W=10 t, R=20 m and H=37 m) is inputted to the input part 61 (S1), the CPU extracts telescopic patterns No. 21, 22, 24 to 34 (the bottom row of the performance table shown in FIG. 5) satisfying the operating condition, from data corresponding to the performance table (S2). Next, since multiple kinds of telescopic patterns are extracted (S3) and the priority is not time (S4), telescopic pattern No. 21 that maximizes the net rated load, is selected from among the extracted telescopic patterns (S6). Finally, the selected telescopic pattern No. 21 is displayed on the display device 65 (S8).

Next, another process of selecting telescopic patterns will be described in detail where the telescopic pattern before start of a crane operation is telescopic pattern No. 1, the weight of the counterweight 32 is 40 t, and the width of the extended outriggers 13 is 7.5 m; a plurality of operating conditions (a first operating condition, a second operating condition and a third operating condition in the order of crane operations) are inputted to the input part 61; and time is set as the priority.

First, when the input part 61 receives, as input, the first operating condition (W=10 t, R=20 m and H=37 m), the second operating condition (W=11 t, R=26 m and H=2 m), and the third operating condition (W=45 t, R=4 m and H=15 m) (S1), respective telescopic patterns satisfying these operating conditions are extracted, from among data corresponding to the performance tables (S2). Here, telescopic patterns No. 21, 22, 24 to 34 are extracted for the first operating condition. Telescopic patterns No. 15, 18, 22 and 25 are extracted for the second operating condition. Telescopic patterns No. 2, 3, 5 to 7 and 9 to 11 are extracted for the third operating condition. Next, since multiple kinds of telescopic patterns are extracted for each condition (S3) and the priority is time (S4), a combination of telescopic patterns that minimizes a period of time for telescopic motion is selected from among the extracted telescopic patterns (S5). Here, when telescopic motion is performed in the order: telescopic pattern No. 1; the telescopic pattern satisfying the first operating condition; the telescopic pattern satisfying the second operating condition; and the telescopic pattern satisfying the third operating condition, a telescopic pattern satisfying each operating condition is selected to minimize the moving distance of each of the boom members 41*b* to 41*f* and the number of times each of the boom members 41*b* to 41*f* moves. In addition, when the telescopic boom 40 performs telescopic motion, the telescopic pattern is selected according to the order of the telescopic boom members 41 performing telescopic motion. It is because, when the telescopic boom 40 extends, the boom members 41 consecutively perform telescopic motion in the order from the boom member 41 in the leading edge side, and, on the other hand, when the telescopic boom 40 contracts, the boom members 41 consecutively perform telescopic motion in the order from the boom member 41 in the bottom side. As for the relationship between the length of the telescopic boom 40 and those operating conditions, the length of the telescopic boom 40 is longer in the order: the first operating condition; the second operating condition; and the third operating condition. Therefore, for the first operating condition, a telescopic pattern to increase the length of telescopic boom 40 a little is selected, and, for each of the second and third operating conditions, a telescopic pattern is selected to minimize the period of time for telescopic motion by performing the telescopic motion of the boom member 41 in the bottom side, which has the telescopic pattern selected for the first operating condition. In this case, the telescopic pattern No. 21 satisfying the first operating condition is selected within the minimum period of time for telescopic motion changing from the telescopic pattern No. 1; the telescopic pattern No. 15 satisfying the second operating condition is selected by performing the telescopic motion of only the second boom member 41*b* changing from the telescopic pattern No. 21; and the telescopic pattern No. 11 satisfying the third operating condition is selected by performing the telescopic motion of only the third boom member 41*c* changing from the telescopic pattern No. 15. Finally, the display device 65 displays the telescopic pattern No. 21 selected for the first operating condition, the telescopic pattern No. 15 selected for the second operating condition, and the telescopic pattern No. 11 selected for the third operating condition (S8).

In this way, with the crane apparatus 1 according to the present embodiment, the input part 61 receives, as input, an operating condition for a crane operation including at least weight W of the goods suspended by the telescopic boom 40, height H to which the suspended goods are lifted, and moving radius R of the suspended goods; and a telescopic pattern of the telescopic boom 40 that allows the crane operation under the operating condition inputted to the input part 61, is selected from among a plurality of telescopic patterns. By this means, a telescopic pattern of the telescopic boom 40 that allows a crane operation is selected from among a plurality of telescopic patterns, with easy operation that a predetermined condition is inputted to the input part 61, and therefore it is possible to improve operational efficiency.

In addition, when there are a plurality of telescopic patterns of the telescopic boom 40 that allows a crane operation under each operating condition inputted to the input part 61, the telescopic pattern may be selected to minimize the total period of time for the telescopic motion changing from the telescopic pattern of the telescopic boom 40 detected by the state detecting part 62 to the telescopic pattern that allows the last crane operation. By this means, the telescopic pattern of the telescopic boom 40 is selected for each operating condition to minimize the period of time required for the telescopic motion for a plurality of crane operations.

In addition, when there are a plurality of telescopic patterns of the telescopic boom 40 that allow a crane operation under the operating condition inputted to the input part 61, the telescopic pattern that maximizes the net rated load, may be selected. By this means, the telescopic boom 40 can suspend goods in the telescopic pattern having a substantially greater net rated load than weight W of the suspended goods, and therefore it is possible to improve the safety.

Although, with the embodiment, an all terrain crane as shown in FIG. 1 is used as an example of the crane apparatus, the present invention is not limited to this, and the crane apparatus may be a rough terrain crane, a crawler crane and a truck crane as long as a multistage telescopic boom is provided.

Moreover, although, with the embodiment, in a case in which a plurality of crane operations are consecutively performed, a combination of telescopic patterns that minimizes the period of time for telescopic motion is selected from among the extracted telescopic patterns, the present invention is not limited to this. For example, another configuration is possible where a telescopic pattern that minimizes the period of time for telescopic motion changing from the previous telescopic pattern of the telescopic boom 40, is selected for each crane operation, from a plurality of extracted telescopic patterns.

Moreover, although, with the embodiment, a case has been shown where the weight of the counterweight 32 is detected by the counterweight's weight detecting part 63 and the width of the extended outriggers 13 is detected by the outrigger width detecting part 64, the present invention is not limited to this. For example, when the operator inputs the weight of the counterweight 32 and the width of the extended outrigger 13 to the input part 61 as an operating condition, it is possible to select the optimum telescopic pattern of the telescopic boom 40 like the above-described embodiment.

Moreover, although, with the embodiment, a case has been shown where one optimum telescopic pattern is displayed on the display device 65 based on the priority for one operating condition when a plurality of extracted telescopic patterns match the one operating condition, the present invention is not limited to this. For example, when a plurality of telescopic patterns match one operating condition, all these telescopic patterns may be displayed on the display apparatus 65, or all the extracted telescopic patterns may be displayed on the display device 65 in the order from the optimum telescopic pattern.

The invention claimed is:

1. A crane apparatus comprising:

a telescopic boom including a plurality of boom members, and one telescopic cylinder, the telescopic boom performing telescopic motion by moving the plurality of boom members one by one using the one telescopic cylinder;

a condition input part configured to receive a user input for an operating condition for a crane operation, the user input including at least a weight of goods suspended by the telescopic boom, a height to which suspended goods are lifted, and a moving radius of the suspended goods; and a telescopic pattern selecting part configured to select a telescopic pattern that allows the crane operation under the operating condition inputted to the condition input part.

2. The crane apparatus according to claim 1, wherein when there are a plurality of telescopic patterns that allow the crane operation under the operating condition inputted to the condition input part, the telescopic pattern selecting part selects a telescopic pattern that minimizes a period of time for telescopic motion changing from a previous telescopic pattern.

3. The crane apparatus according to claim 1, wherein: the condition input part can receive user inputs for operating conditions for a plurality of crane operations and an order of the crane operations; and when there are a plurality of telescopic patterns of the telescopic boom that allow the crane operation under each operating condition inputted from the condition input part, the telescopic pattern selecting part selects each telescopic pattern that minimizes a period of time for entire telescopic motion of the telescopic boom changing from a telescopic pattern before a start of a telescopic motion to a telescopic pattern of a last crane operation.

4. The crane apparatus according to claim 1, wherein when there are a plurality of telescopic patterns of the telescopic boom that allow the crane operation under the operating condition inputted to the condition input part, the telescopic pattern selecting part selects a telescopic pattern that maximizes a net rated load.

* * * * *